US007637218B1

(12) United States Patent
Burton

(10) Patent No.: US 7,637,218 B1
(45) Date of Patent: Dec. 29, 2009

(54) WEARABLE STORAGE SYSTEM

(76) Inventor: Christopher Sebastian Burton, 965 Bay Rd., East Palo Alto, CA (US) 94303

( * ) Notice: Subject to any disclaimer, the term of this patent is extended or adjusted under 35 U.S.C. 154(b) by 406 days.

(21) Appl. No.: 10/970,967

(22) Filed: Oct. 22, 2004

(51) Int. Cl.
*A47B 23/00* (2006.01)

(52) U.S. Cl. ..... 108/43; 224/153; 2/253

(58) Field of Classification Search ..... 108/43; 224/153; 190/11; 2/93, 94, 247, 253
See application file for complete search history.

(56) References Cited

U.S. PATENT DOCUMENTS 1,076,260 A * 10/1913 Arenson ..... 2/253
1,291,914 A * 1/1919 Kelley ..... 2/253
1,485,567 A * 3/1924 Roberts ..... 2/253
1,491,979 A * 4/1924 Wood ..... 2/254
1,517,120 A * 11/1924 McDonald ..... 2/253
1,632,660 A * 6/1927 McDonald ..... 2/253
3,085,254 A * 4/1963 Cutler ..... 2/243.1
4,085,873 A * 4/1978 Schweitzer ..... 224/153
4,236,657 A * 12/1980 Brunton ..... 224/153
4,513,455 A * 4/1985 Gerhardt ..... 2/253
4,609,084 A * 9/1986 Thomas ..... 224/153
4,721,237 A * 1/1988 Leslie ..... 224/153
5,072,456 A * 12/1991 Elin ..... 2/94
5,165,111 A * 11/1992 Lieberman ..... 224/153
5,186,290 A * 2/1993 Takayama ..... 190/108
5,407,112 A * 4/1995 Christodoulou et al. ..... 224/153
5,467,853 A * 11/1995 Pelletier ..... 190/11
5,544,792 A * 8/1996 Arnwine ..... 224/153
5,560,524 A * 10/1996 Brune ..... 224/153
5,642,674 A * 7/1997 Joye et al. ..... 108/43
5,653,337 A * 8/1997 Cirigliano ..... 224/153
5,680,973 A * 10/1997 Vulpitta et al. ..... 224/153
5,699,560 A * 12/1997 Greenberg ..... 2/94
6,149,041 A * 11/2000 Perino et al. ..... 224/645
6,193,118 B1 * 2/2001 Kearl ..... 224/153
6,216,926 B1 * 4/2001 Pratt ..... 224/153
6,244,481 B1 * 6/2001 Brougher ..... 224/153
6,305,587 B1 * 10/2001 Miller ..... 224/153
6,308,875 B1 * 10/2001 Almo ..... 2/253
6,336,577 B1 * 1/2002 Harris et al. ..... 224/153
6,510,974 B2 * 1/2003 Willingham et al. ..... 224/153
6,655,565 B2 * 12/2003 Godshaw et al. ..... 224/653

* cited by examiner

*Primary Examiner*—José V Chen
(74) *Attorney, Agent, or Firm*—Risto A. Rinne, Jr.

(57) ABSTRACT

An apparatus for storage of cargo items is worn by a user. An upper end of the apparatus is secured to a belt of the user and a lower end is secured to a leg of the user. A continuous perimeter zipper with two zipper closure tabs allows versatility in opening an exterior portion apart from a main portion while preventing the exterior portion from being separated apart from the main portion. A pair of horizontal pockets face each other and allow ambidextrous usage. Interior pockets that open and close at either end allow usage in either a right side up or upside down orientation of the exterior portion. A pair of interior pockets can be opened so as to provide extended storage room.

18 Claims, 4 Drawing Sheets

WEARABLE STORAGE SYSTEM

BACKGROUND OF THE INVENTION

1. Field of the Invention

The present invention, in general, relates to packs and containers that are worn and, more particularly, to a storage system that accommodates various storage requirements.

The need for a person to carry gear is as old as the pocket. However, the nature of the gear is ever changing and a need to transport new types of items brings new challenges to overcome.

For example, cellular telephones (cell phones) are common today and they require a safe storage container that also allows rapid access once the cell phone begins to ring.

Additionally, a unique requirement also occurs with cell phones that display the number of the person calling, a feature commonly known as "caller ID". Once a cell phone begins to ring, the recipient of the call has the luxury of deciding whether or not to answer the call at that time. This decision is usually predicated upon who is calling.

Accordingly, the recipient of the call will glance at a display screen on the cell phone to decide whether or not to answer the incoming call. This requires the user to not only quickly access the cell phone but to be able to see it in a proper orientation, with the display screen right side up, for example.

Additionally, if a cell phone is stored deep within a storage device that surrounds the cell phone with protective materials, it may be difficult to hear the cell phone when it does ring.

Other types of users will have different needs. For example, an executive (i.e., businessman) may likely have need to transport a laptop computer, another new innovation.

The laptop may be used by the executive while on a train, subway, airplane, bus or other mass transit type of a vehicle. It may even be used by the executive while in the back seat of a taxi cab.

Not only is the safe transport of the laptop required, but it must be rested on a surface that is at a convenient height for typing and at a convenient distance from the user so the display can be optimally seen.

Sports enthusiasts will have vastly different needs. For example, a person in training may want to add weights to their person to use in developing increased muscle strength and endurance.

There are also common items that most people must carry, for example, keys. There is an important need that important keys (i.e., house or office) not be lost and also that they be readily accessible.

A still further need is to provide a storage system that can be worn by a user in such a manner as to leave both hands of the user free for other tasks.

Adding to the difficulty of finding a solution to the above needs, is the fact that people are both right and left handed. An ideal wearable storage system would be adapted to accommodate use on either a right or left side of a person.

Accordingly, there exists today a need for a wearable storage system that can help to ameliorate the above-mentioned problems and difficulties.

Clearly, such an apparatus and system would be useful and desirable.

2. Description of Prior Art

Storage devices are, in general, known. For example, the following patents and pending applications describe various types of these devices:

U.S. Patent Application Publication No. 2003/0213827 A1 to Langmuir that published on Nov. 20, 2003;

U.S. Patent Application Publication No. 2003/0141328 A1 to Cragg that published on Jul. 31, 2003;

U.S. Pat. No. 4,303,239 to Walsh, Jr. that issued on Dec. 1, 1981;

U.S. Pat. No. 5,445,303 to Cawile, Jr. that issued on Aug. 29, 1995; and

U.S. Design Pat. No. Des. 435,338 to DiLorenzo that issued on Dec. 26, 2000.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a wearable storage system that is adapted to be worn by a user.

It is also an important object of the invention to provide a wearable storage system that can be suspended from a waist and secured to a leg of a user.

Another object of the invention is to provide a wearable storage system that can be used by a right or a left-handed user.

Still another object of the invention is to provide a wearable storage system that can hold a cell phone.

Still yet another object of the invention is to provide a wearable storage system that can hold a laptop computer.

Yet another important object of the invention is to provide a wearable storage system that can hold keys.

Still yet another important object of the invention is to provide a wearable storage system that can hold weights.

A first continuing object of the invention is to provide a wearable storage system that includes a zippered exterior.

A second continuing object of the invention is to provide a wearable storage system that includes a zippered exterior with a double-end zipper.

Briefly, a wearable storage system that is constructed in accordance with the principles of the present invention has a substantially rectangular main portion that is suspended at a top end thereof from a waist of a user. A leg strap secures an opposite bottom end of the main portion to a leg of the user. An exterior portion having a similar length and width as the main portion is secured by a perimeter zipper that extends around the full length of the perimeter and has a pair of zipper opening tabs that face each other and extend in opposite directions, thereby allowing any section of the exterior portion to be opened with respect to the main portion, but not allowing the exterior portion to be removed apart from the main portion. Variations in the design accommodate a laptop computer with a table, cell phone compartments, and retractable key ring.

DETAILED DESCRIPTION OF THE INVENTION

Figures 1, 1A:
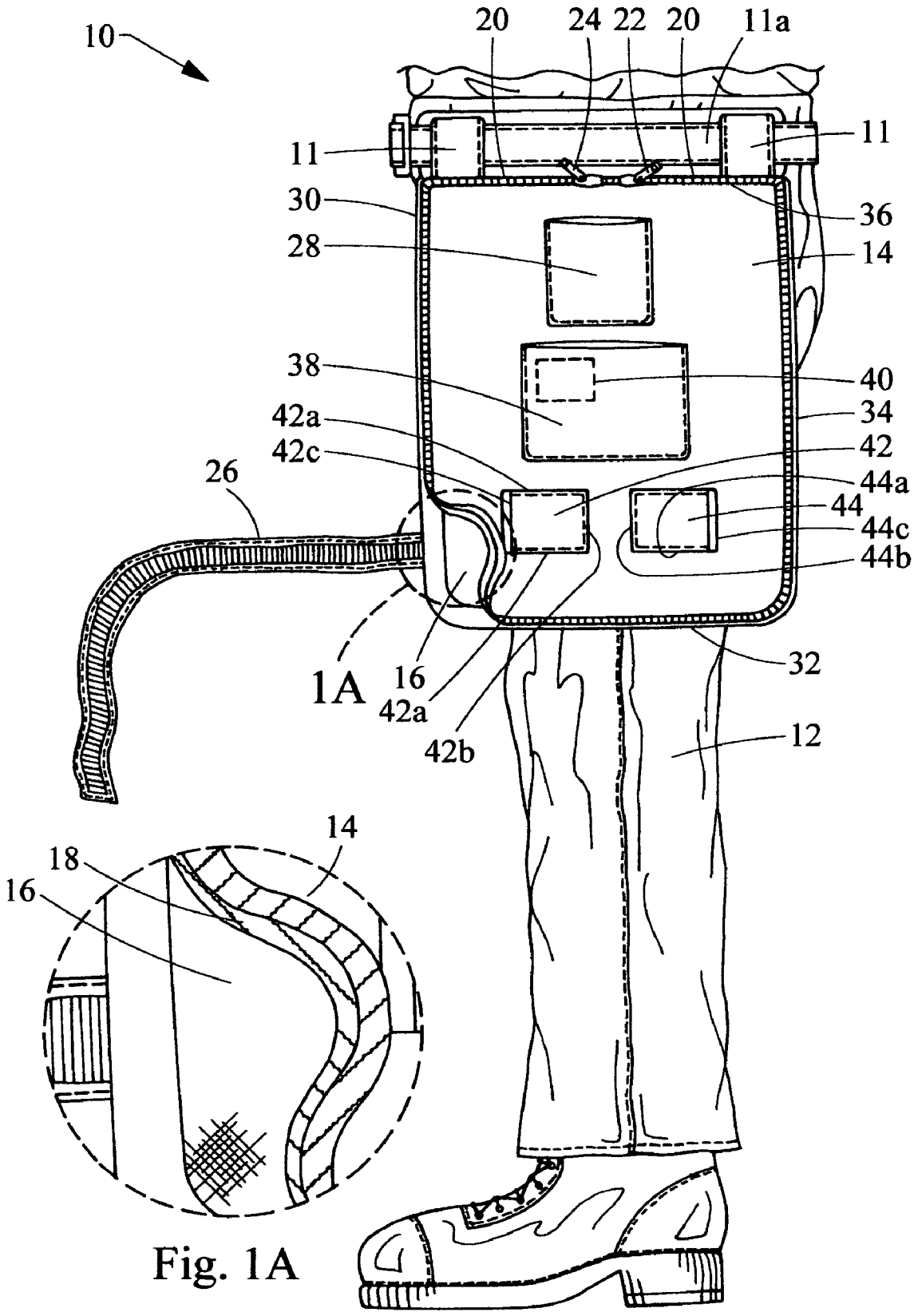
FIG. 1 is a side elevational view of a wearable storage system in a closed position.

Referring to all of the drawings and in particular now to FIG. 1 is shown, a wearable storage system that is identified, in general, by the reference numeral 10. The wearable storage system 10 is disposed in a closed position.

A pair of belt loops 11 secure an upper portion of the wearable storage system 10 to a belt 11*a* of a user.

The wearable storage system 10 is shown attached to a left side of the user and is secured to a leg 12 of the user, in this example, the left leg 12.

The wearable storage system 10 is shown in a closed position, ready for transport, except for Inset A, which shows a portion of an exterior portion 14 that is pulled back from a main portion 16 to illustrate a layer of cushion material 18 that the interior of the exterior portion 14 is lined with.

A perimeter zipper 20 includes a pair of zipper opening tabs 22, 24 that face each other and extend in opposite directions, thereby allowing any section of the exterior portion 14 to be opened with respect to the main portion 16, but not allowing the exterior portion 14 to be removed apart from the main portion 16. This is illustrated in greater detail hereinafter.

A leg strap 26 is provided (shown in an open position) that is attached at one end thereof to the main portion 16. The leg strap 26 preferably includes a first half of a hook and loop fastener that is adapted to be secured around the leg 12 and attached to a second half of the hook and loop fastener that is attached to another portion of the wearable storage system 10.

If preferred, any known type of a buckle or a second strap half can instead be attached to an opposite side of the main portion 16 of the wearable storage system 10 sufficient to enable the leg strap 26 to extend around the leg 12 of the user and for the user to secure a lower portion of the main portion 16 around the leg 12.

To accommodate the use of a cell phone, a variety of options are provided. It is to be understood that the various elements, as are described hereinafter can be used to secure other items and that they can be modified as desired.

It is also understood that many materials may be used in the manufacture of the wearable storage system 10, including rigid materials like plastic as well as flexible materials like nylon or vinyl, as well as other materials or combinations of materials. The materials used are selected based on the needs of the particular item(s) to be carried by the wearable storage system 10.

A middle outside pocket 28 is open at the top and closed at the bottom and sides and can be used to secure a cell phone that is inserted from above. If preferred, the outer material may be transparent to allow viewing of the cell phone.

The user, on hearing the cell phone ring, can loosen the leg strap 26 and raise the entire wearable storage system 10, pivoting it about the belt loops 11. If the cell phone is inserted into the middle outside pocket 28 in an upside down fashion, such pivoting will permit the reading of any display screen on the cell phone.

The user can, instead, unzip the two zipper tabs 22, 24 so that a left side 30 is open, a bottom side 32 is open, a right side 34 is open and a portion of a top side 36 is closed. When the perimeter zipper 20 is in this position, the exterior portion 14 can be pivoted up around the top side 36, which acts as a hinge for viewing and access of the cell phone.

A larger clip board pocket 38 is provided for insertion of a clip board therein that is similar to the middle outside pocket 28 in that it is open at a top and closed at a bottom and two sides.

A logo 40 or brand name can be added where desired.

For many users, side access of the cell phone is preferred; however the wearable storage system 10 can be used with either the right or left leg 12, as is described in greater detail hereinafter.

To accommodate ambidextrous use of the wearable storage system 10, a pair of horizontal cell phone pockets 42, 44 are provided. Both of the horizontal cell phone pockets 42, 44 are closed at a top and bottom side 42*a*, 44*a*. Both of the horizontal cell phone pockets 42, 44 are also closed in a middle side 42*b*, 44*b* that are both proximate each other. The horizontal cell phone pockets 42, 44 are each open at an opposite distal side 42*c*, 44*c* for insertion and removal of the cell phone from whichever of the two horizontal cell phone pockets 42, 44 is preferred.

Figure 2:
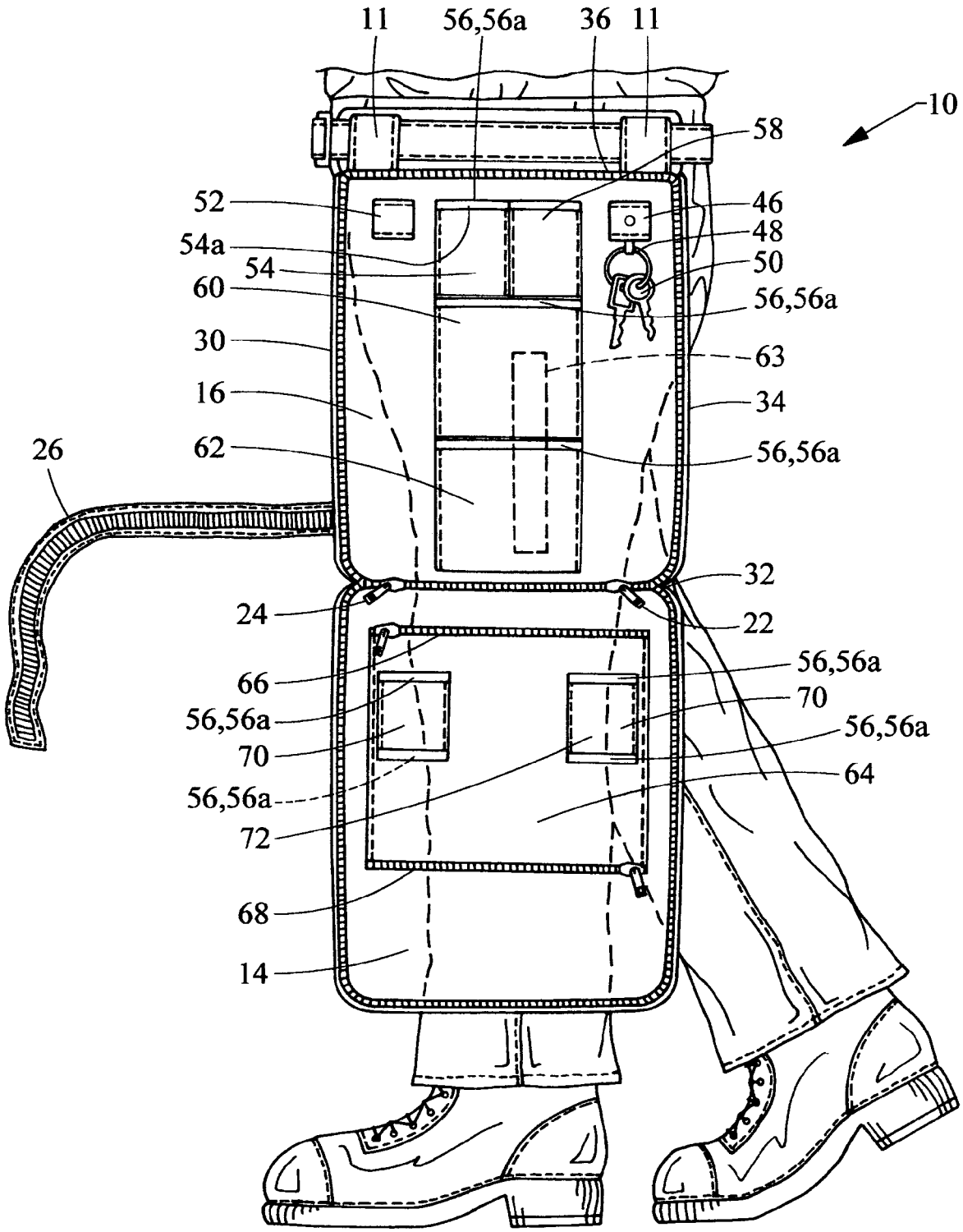
FIG. 2 is a side elevational view of a wearable storage system of FIG. 1 in a first open position.

Referring now to FIG. 2, the wearable storage system 10 is shown with the exterior portion 14 pivoted into a first open position. To attain the first open position, the user unzips the two zipper tabs 22, 24 so that the left side 30 is open, the right side 34 is open, the top side 36 is open, and a portion of the bottom side 32 is closed.

When the perimeter zipper 20 is in this position, the exterior portion 14 can be pivoted down around the bottom side 32, which acts as a hinge.

The first open position allows access to an interior of the wearable storage system 10. The following elements are all attached to an exposed interior surface of the main portion 16.

A first key clip 46 is used to secure to secure a retractable key chain 48 that permits a key 50 to be extended and retracted back, as desired.

This ensures that the key 50, which is especially important, is always handy and can never be lost. To increase fast access to the key 50, the wearable storage system 10 may be used in the closed position (FIG. 1) and the two zipper tabs 22, 24 offset slightly at the top of the right side 34. The two zipper tabs 22, 24 are then separated enough from each other so as to create an opening for the key 50 and key chain 48 to extend out as needed and to retract back into an interior of the wearable storage system 10.

A second key clip 52 is used to secure another key (not shown) or key ring (not shown) or a second retractable key chain (not shown), if desired.

An inside cell phone pocket 54 is closed at a horizontal bottom and at two opposite vertical sides. A top side 54*a* includes a first half of a hook and loop fastener 56 that cooperates with a second half 56*a*. The second half 56*a* is attached to the main section 16 and when the first half 56 and second half 56*a* are pressed together, the inside cell phone pocket 54 is closed.

An inside credit card holder 58 is similarly constructed as is the inside cell phone pocket 54.

An upper cash and change pocket 60 is disposed over a lower small storage pocket 62 of a similar size (i.e., width). The small storage pocket 62 is closed at the sides and bottom and it also includes, at an upper end, a section of the first half of the hook and loop fastener 56 that cooperates with the second half 56*a* so that the top of the small storage pocket 62 can be opened.

The cash and change pocket 60 is closed at the sides and it also includes, at both an upper and lower end, a section of the first half of the hook and loop fastener 56, 56*a* that cooperates with the second half 56*a* so that both the top and bottom of the cash and change pocket 60 can be opened and closed.

This arrangement increases the utility of both pockets 60, 62 by allowing the user to use each independent of the other and, when a larger or longer item is to be stored, the top of small storage pocket 62 is opened as are both the top and bottom of the cash and change pocket 60.

The larger/longer item is then inserted in from the top of the cash and change pocket 60, out the bottom of the cash and change pocket 60, and into the top of the smaller storage pocket 62 until, preferably, the top of the cash and change pocket 60 can be closed sufficient to secure the larger/longer item in both pockets 60, 62.

One possible larger/longer item includes a weight 63 that is shown in dashed lines.

This increases the versatility of the wearable storage system 10 by allowing it to have multiple pockets 60, 62 to accommodate various smaller items that can be combined and used together to secure larger items.

The following elements are all attached to an exposed interior surface of the exterior portion 14 that is readily accessible in the first open position.

A large storage pocket 64 is secured by upper and lower inside zippers 66, 68 that can be opened independent of one another or both together to provide similar benefits in securing larger or longer items, as was described hereinabove.

A left small pocket 70 and a right small pocket 72 each also include, at both an upper and lower end, a section of the first half of the hook and loop fastener 56, 56*a* that cooperates with the second half 56*a* so that both the top and bottom of the left and right small pockets 70, 72 can be opened and closed independent of one-another.

This provides increased versatility in that a desired item, for example the cell phone, can be inserted in either small pocket 70, 72 from either end. That way it would be optimally easy to insert and withdraw the cell phone (or other item) from either small pocket 70, 72 whether the wearable storage system 10 was in the closed position (FIG. 1) or in the first open position (FIG. 2).

Figure 3:
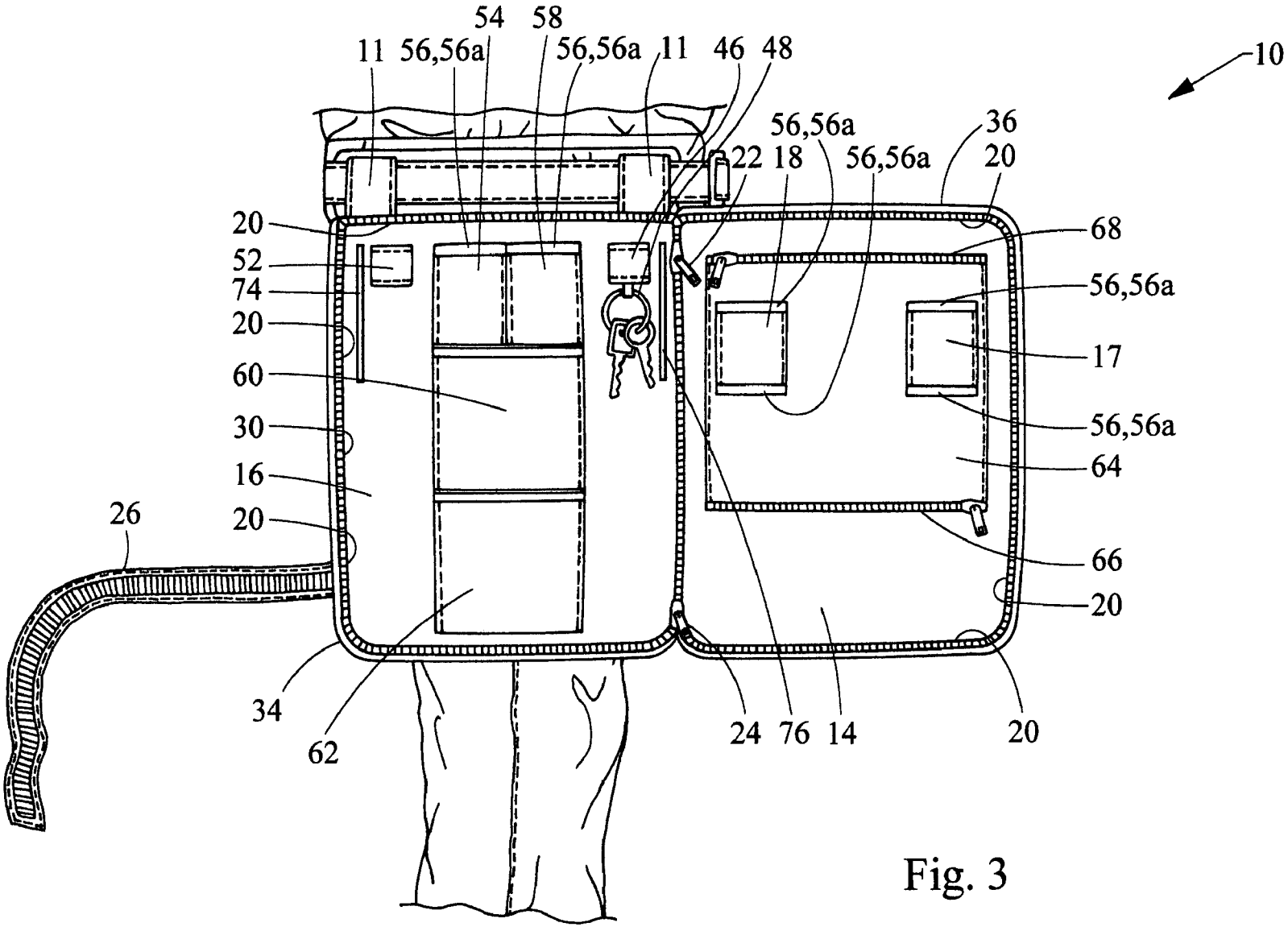
FIG. 3 is a side elevational view of a wearable storage system of FIG. 1 in a second open position, and worn on an opposite side of a user.

Referring now to FIG. 3, the wearable storage system 10 is shown with the exterior portion 14 pivoted into a second open position. It is important to note that the wearable storage system 10 is now disposed on a right hip of the user (as opposed to a left hip in FIG. 1 and FIG. 2). This illustrates how the wearable storage system 10 can be worn on either side and how it can accommodate the needs of either right or left-handed users.

To attain the second open position, the user unzips the two zipper tabs 22, 24 so that the left side 30 is open, the bottom side 32 is open, the top side 36 is open, and a portion of the right side 34 is closed.

When the perimeter zipper 20 is in the second open position, the exterior portion 14 can be pivoted out in front of the user around the right side 34, which acts as a hinge.

In the second open position, it is important to note that all of the pockets 17, 18, 64 are now upside down and offset right to left, as compared to their previously described position relative to the user when the wearable storage system 10 was in the first open position.

The ability to open and close the upper and lower inside zippers 66, 68 independent of each other allows for normal functioning of the large storage pocket 64 regardless of its position (upside down, right-side up, or reversed left to right).

The perimeter zipper 20 with the two zipper tabs 22, 24 allows the two tabs 22, 24 to be displaced anywhere desired along the entire length of the perimeter zipper 20. When both of the tabs 22, 24 are disposed on any given side, by default the remaining three sides are open and the zipper 20, on the side the tabs 22, 24 are on, becomes a hinge.

While it is possible to open both tabs 22, 24 fully so they meet somewhere along the length of the perimeter zipper 20, it is not possible to remove the exterior portion 14 apart from the main portion 16, even if the two tabs 22, 24 are fully open and abut each other (in the open position). This is because a small portion of the perimeter zipper 20 that is intermediate the two tabs 22, 24 will still remain closed sufficient to retain the exterior portion 14 in cooperation with the main portion 16.

Accordingly, the full length, continuous perimeter zipper 20 (with no breaks along its entire length) and the two zipper tabs 22, 24 cooperate together to provide the versatility and benefits as described herein.

This provides the user with ease and great freedom to experiment as to how he or she wants to use the wearable storage system 10 without worry that it might become "undone" in some manner.

If desired, a left slot 74 or a right slot 76 can be included proximate the first and second key clips 46, 52. The left and right slots 74, 76 would include an opening (separate from the perimeter zipper 20) through which the retractable key chain 48 and key 50 could extend and protrude slightly from the wearable storage system 10, even when the perimeter zipper 20 is fully in the closed position.

Of course, the wearable storage system 10 can be made in any size to accommodate any need. For example, larger pockets can be included to accommodate weights for fitness training. By storing the weights inside, they are not visible to others who cannot therefore know the level of fitness that has been attained. This can provide a psychological advantage in certain sports. Such a version of the wearable storage system 10 would be a "sports" model. Other "sports" models are anticipated that accommodate the items unique to other sports and activities.

Alternately, all of the pockets 54, 58 60, 62 that are attached to the main portion 16 can be eliminated and a surface can be inserted into the wearable storage system 10.

Figure 4:
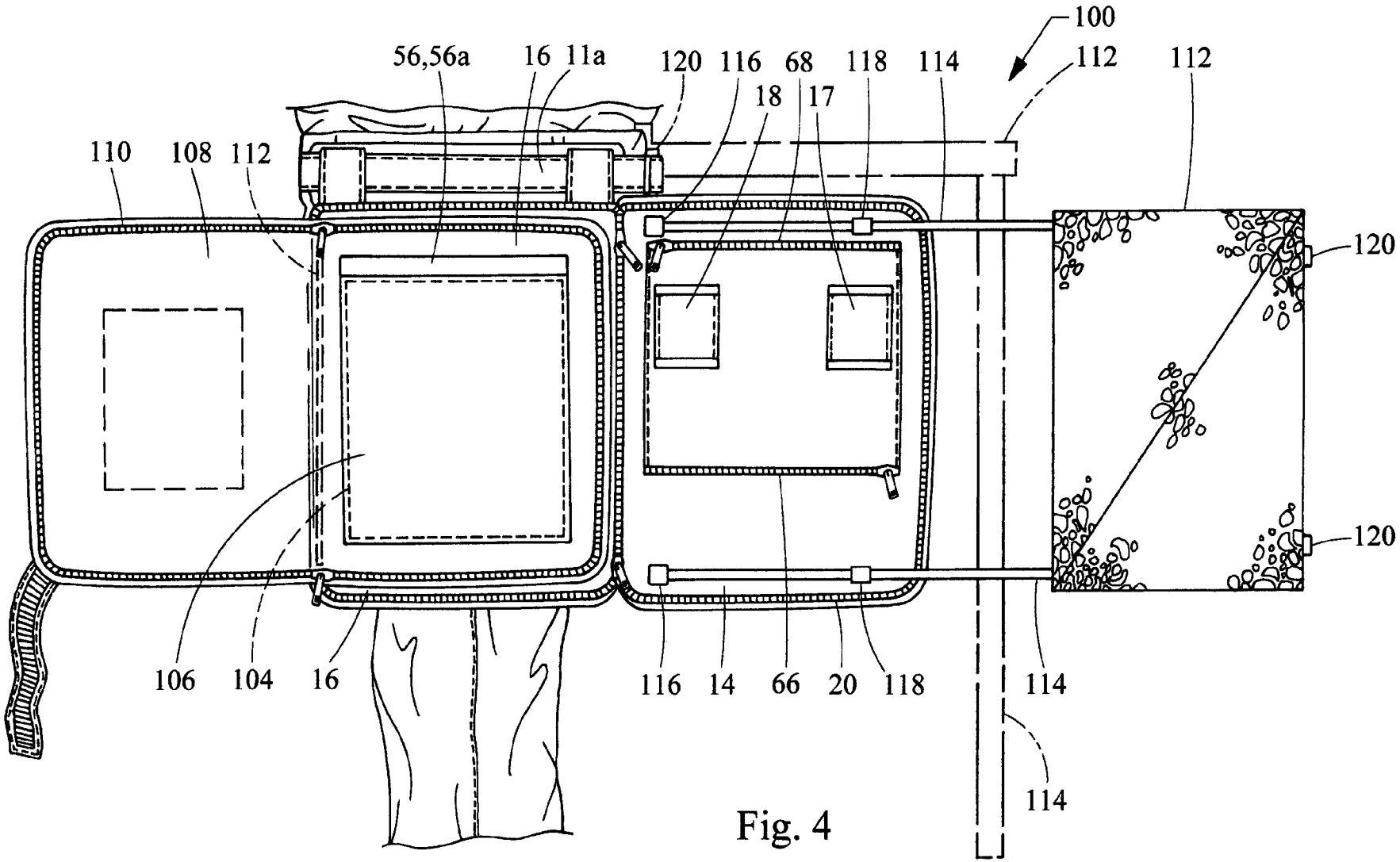
FIG. 4 is a side elevational view of a modified wearable storage system disposed in a third open position.

Referring now to FIG. 4, a modified wearable storage system 100 is provided that is generally larger than the wearable storage system 10. The modified wearable storage system 100 is shown with the exterior portion 14 pivoted into a third open position.

The modified wearable storage system 100 is intended for business people and executives who use a laptop computer 104 (dashes lines) that is stored in a large interior pocket 106. The large interior pocket 106 is attached to the main portion 16.

The large interior pocket 106 is closed on the sides and bottom and includes the hook and loop fastener 56, 56*a* at the top which is opened and closed to accept the laptop computer 104 therein. Padding (not shown) is, of course, included as desired in the main portion 16, behind the computer 104.

An interior door 108 includes a second perimeter zipper 110 that, when fully opened, allows the interior door 108 to pivot about an interior flexible hinge 112 (dashed line) and allow access to the large interior pocket 106.

Padding in the interior door 108 may be included to better protect the computer 104.

To open and use the modified wearable storage system 100, the perimeter zipper 20 is opened a manner similar to that as was previously described for the wearable storage system 10 of FIG. 3. This interim position is similar to the second open position.

The second perimeter zipper 110 is then opened and the interior door 108 is pivoted about the interior flexible hinge 112 into the third open position to allow access to the large interior pocket 106 in particular, and to an interior of the modified wearable storage system 100 in general.

A table 112 is provided in the modified wearable storage system 100 that is attached to an interior of the exterior portion 14. The table 112 includes a pair of extensible legs 114. The extensible legs 114 include a plurality of segments that telescope into each other and into a closed position that is disposed underneath a plane of the table 112. This position is for storage, with the table 112 and extensible legs 114 adjacent to the exterior portion 14 and contained within the perimeter zipper 20.

Retaining members 116 secure a first end of each of the extensible legs 114 to the interior of the exterior portion 14. Intermediate retaining members 118 secure an intermediate portion of the extensible legs 114, and therefore the table 112 as well, to the interior of the exterior portion 14 during transport.

An opposite end of each of the extensible legs 114 is pivotally attached to an underside of the table 112.

The retaining members 116 and intermediate retaining members 118 are loosened, as desired, and the table 112 is removed apart from the exterior member 14.

The extensible legs 114 are each extended a preferred amount. They are each secured in whatever extended position is preferred by friction, or by whatever mechanism is preferred.

A pair of clips 120 are attached to a front of the table 112 and can be used to secure the front of the table 112 to the belt 11*a* of the user, as shown in dashed lines in FIG. 4. It is expected that usually the user will be in a seated position (not standing, as shown) when the clips 120 are placed over the users belt 11*a* (or top of his or her trousers). The first end of the extensible legs 114 rests on the floor and a portable table 112 is provided upon which to place the laptop computer 104.

The laptop computer 104 is then removed from the large interior pocket 106 and placed on the table 112 for use while seated in an airplane or other vehicle. It is of course possible to provide especially long extensible legs 114 that can accommodate use when standing.

It is of course possible to replace the clips 120 with other means of securing the table 112 to the user or to another object, as desired, including possibly securing the table to a portion of the modified wearable storage system 100.

To close the modified wearable storage system 100 the computer 104 is returned to the large interior pocket 106, which is sealed. The table 112 is removed from the belt 11*a* and the extensible legs 114 are fully retracted and pivoted under the plane of the table 112, which is then placed in and secured to the exterior portion 14 by the retaining members 116 and the intermediate retaining members 118. The interior door 108 is closed by closing the second perimeter zipper 110. The perimeter zipper 20 is then closed to bring the modified wearable storage system 100 back into the closed position.

Other modifications are, of course, possible in view of the instant disclosure and claims.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A wearable storage system, comprising:

(a) a main portion that is generally planar;

(b) an exterior portion that is generally planar and includes an overall length and width that is similar to that of said main portion;

(c) a continuous perimeter zipper that extends around a perimeter of said main portion and of said exterior portion and is used to retain said exterior portion relative to said main portion;

(d) a pair of zipper closure tabs that are adapted to be urged along a length of said perimeter zipper wherein any portion of a length of said perimeter zipper is adapted to be opened while at least a portion of said perimeter zipper will always remain closed sufficient to retain said exterior portion relative to said main portion; and (e) when said wearable storage system is worn in a normal position for use, adjacent a waist of a user an upper pocket is disposed adjacent to and directly above a similar size lower pocket and wherein said lower pocket is closed at a pair of opposite sides thereof and wherein said lower pocket is closed at a bottom side thereof, and wherein said lower pocket includes means for opening and closing an upper side thereof, and wherein said upper side of said lower pocket is adjacent to a lower side of said upper pocket, and wherein said upper pocket is closed at a pair of opposite sides thereof and wherein said upper pocket includes means for opening and closing an upper side thereof and wherein said upper pocket includes means for opening and closing said lower side thereof, and wherein when said lower side of said upper pocket is open and said upper side of said lower pocket is open said lower pocket and said upper pocket are adapted to simultaneously receive an item therein, and wherein a portion of said item is contained in said lower pocket and a remaining portion of said item extends out of said lower pocket, and wherein all of said remaining portion that is not disposed between said lower pocket and said upper pocket is contained in said upper pocket, and wherein said item includes a dimension sufficiently large as to prevent said lower pocket from enclosing all of said item and wherein said item includes a dimension sufficiently large as to prevent said upper pocket from enclosing all of said item, and wherein said lower pocket and said upper pocket combine to produce a larger overall pocket that is able to contain an item that could not otherwise be contained by either said upper pocket or by said lower pocket in isolation, and wherein when said item is disposed in both said lower pocket and said upper pocket and wherein when said means for opening and closing an upper side of said upper pocket is disposed in the closed position, said item is contained in said overall pocket and is unable to be removed from said overall pocket.

2. The wearable storage system of claim 1 including a detachable table, said detachable table adapted to be stored in an interior of said wearable storage system and surrounded by said perimeter zipper.

3. The wearable storage system of claim 2 wherein said table includes an extensible leg, said extensible leg adapted to retract into a first retracted position and extend into a second extended position, and wherein said extensible leg is pivotally attached at one end thereof to said table.

4. The wearable storage system of claim 3 including a second extensible leg that is pivotally attached at one end thereof to said table.

5. The wearable storage system of claim 2 wherein said table includes means for securing a front of said table to an object.

6. The wearable storage system of claim 5 wherein said object includes a belt of said user.

7. The wearable storage system of claim 1 wherein said exterior portion is adapted to be pivoted into a first open position wherein a bottom side of said exterior portion is adapted to pivot around a section of said perimeter zipper that is disposed proximate said bottom side, and wherein an interior of said exterior portion is disposed, relative to a user, in a first position.

8. The wearable storage system of claim 7 wherein said exterior portion is adapted to be pivoted into a second open position wherein a right side of said exterior portion is adapted to pivot around a section of said perimeter zipper that is disposed proximate said right side, and wherein an interior of said exterior portion is disposed, relative to said user, in a second position and wherein when said exterior portion is disposed in said second position it is upside down and offset right to left as compared to said first position relative to said user.

9. The wearable storage system of claim 1 wherein said exterior portion is adapted to be pivoted into a second open position wherein a right side of said exterior portion is adapted to pivot around a section of said perimeter zipper that is disposed proximate said right side, and wherein an interior of said exterior portion is disposed, relative to a user, in a second position.

10. The wearable storage system of claim 1 including means for securing at least one key thereto.

11. The wearable storage system of claim 10 wherein said means for securing at least one key thereto includes means for securing a retractable key chain to said system.

12. The wearable storage system of claim 11 including at least one slot provided in said wearable storage system proximate said retractable key chain, wherein a portion of said retractable key chain is adapted to pass through said at least one slot when said wearable storage system is in a closed position, said closed position occurring when said perimeter zipper is fully closed.

13. The wearable storage system of claim 1 including means adapted for securing at least one weight in an interior of said wearable storage system when said system is in a closed position that is obtained when said perimeter zipper is fully closed.

14. The wearable storage system of claim 1 including a pair of horizontal pockets that are disposed on an exterior surface of said exterior portion and wherein each of said horizontal pockets is closed at a top side thereof and is closed at a bottom side thereof and wherein each of said horizontal pockets is closed at a middle side thereof, and wherein said middle side of a first of said pair of horizontal pockets is disposed proximate said middle side of a second of said pair of horizontal pockets and where each of said middle sides is in parallel alignment with respect to the other, and wherein each of said pair of horizontal pockets is open at a distal side, said distal side of each of said pair of horizontal pockets being disposed distally away from said middle side of each of said horizontal pockets.

15. The wearable storage system of claim 1 including means for providing padding to said main portion.

16. The wearable storage system of claim 1 including means for providing padding to said exterior portion.

17. The wearable storage system of claim 1 including means for attaching an upper end of said system to a belt, said belt adapted to be worn by a user.

18. The wearable storage system of claim 1 including means for securing a lower end of said system to a leg of a user.

* * * * *